United States Patent [19]

Long

[11] 3,974,756

[45] Aug. 17, 1976

[54] APPARATUS AND METHOD FOR FIELD BURNING AND FOG OR SMOG CONTROL

[76] Inventor: Otto V. Long, 3440 SW. Veterans Hospital Road, Portland, Oreg. 97201

[22] Filed: Dec. 19, 1974

[21] Appl. No.: 534,459

[52] U.S. Cl. ..... 98/58; 98/60; 110/184; 52/2; 52/83; 239/14

[51] Int. Cl.[2] ..... E04F 17/02; F23L 17/02

[58] Field of Search ..... 98/58, 60; 110/184; 52/2, 83

[56] References Cited

UNITED STATES PATENTS

| | | | |
|---|---|---|---|
| 546,396 | 9/1895 | Fellenbaum | 110/184 X |
| 3,233,567 | 2/1966 | Goldfield | 98/58 X |
| 3,489,072 | 1/1970 | Secor | 98/58 |
| 3,835,625 | 9/1974 | Williams | 98/58 X |

*Primary Examiner*—John J. Camby
*Assistant Examiner*—Henry C. Yuen
*Attorney, Agent, or Firm*—Chernoff & Vilhauer

[57] ABSTRACT

An exceptionally long, segmented, high-altitude flue of flexible, light-weight material suspended vertically at its upper end from a gas-filled balloon and including at its lower end an open-bottomed hood. The hood segment tapers upwardly from an extremely large bottom opening to its junction with a stack segment. The stack segment is of uniform cross-section throughout and is formed from a plurality of tubular sections permitting the stack to be adjustably raised to any desired height. For field burning purposes, the stack and hood segments are made of a fire-proof material and the bottom hood opening is surrounded by a refractory, rigid-walled enclosure elevated above ground level by skid-type supports. Refire grids of refractory material are provided within the apparatus to minimize the escape of incompletely combusted particulate matter suspended in the hot gases which rise through the hood and stack. Cables connecting both the balloon and the rigid-walled enclosure to winch-equipped ground vehicles are utilized to control the altitude of the stack and the position of the hood enclosure and to advance the enclosure over the ground.

4 Claims, 4 Drawing Figures

FIG, 1a

APPARATUS AND METHOD FOR FIELD BURNING AND FOG OR SMOG CONTROL

BACKGROUND OF THE INVENTION

The present invention relates to an apparatus and method for field burning and fog or smog control. The successful cultivation of certain agricultural crops, for example grass seed, requires that after each season's crop has been harvested and before the next season's crop may be planted the land on which the crop is produced must be sterilized and decontaminated by removing all residual vegetation, seeds and vermin. The predominant method of sterilizing the land is by openly burning the vegetation from the field where it lies. This open burning creates a strong updraft of hot, expanding gases which carries a large quantity of incompletely combusted particulate matter into the atmosphere over the area being cleared. Due to the rapid expansion and resultant cooling of these gases, the particulate matter is dispersed into the atmosphere at a relatively low altitude where it is picked up and carried by the prevailing winds. All to often this low-altitude airborne matter is carried over urban centers where it decreases visibility and creates a hazard to the health of the urban populace. Investigation is being conducted into ways of sterilizing agricultural lands by non-polluting combustion, for example by the use of mobile field burning machines which traverse the ground and burn the vegetation within small controlled combustion chambers. However, such mobile machines are of far too small a capacity and much too expensive to make their use over large acreages economically feasible. Moreover, they too disperse the hot combustion gases, together with unburned particulate matter, at an unsatisfactorily low altitude. In addition, while such mobile field-burning machines are small in comparison to the large acreages they are expected to cover, they are generally too large for convenient road haulage from job to job. Accordingly, to date no acceptable non-polluting means of accomplishing soil sterilization by burning has been discovered.

A similar menace to urban population is created by a condition known as smog, that is, smoke or other pollutants mixed with fog. Normally, the tempeprature of the atmosphere below the stratosphere decreases with altitude with the warmer air near ground level continually rising until its temperature drops to that of the surrounding air. Whenever this air temperature relationship is reversed, such as when a cool stable air mass is trapped over a large area by a similarly stable and relatively warmer air mass overhead (a condition known as a temperature inversion), the rising air currents necessary to mix the polluted air from the lower altitudes with the relatively cooler and clearer air of the higher altitudes are suppressed. This causes the cool, stable air to remain adjacent the ground for considerable periods of time and results in the accumulation of a high concentration of smoke and other pollutants in the air, decreasing visibility and endangering the health of the animal and plant life living within the area. It is not uncommon for these temperature inversions and the resultant accumulations of airborne pollutants to remain in an area for a matter of days or weeks until dispersed by wind or by changes in the temperatures of the respective air masses. To date, no means has been devised to effectively speed up the natural removal of fog or smog from large areas.

SUMMARY OF THE INVENTION

The apparatus and method of the present invention are directed to the use of a high capacity flue means for conducting very large volumes of air having a relatively high concentration of airborne pollutants from a large ground area to an altitude sufficient to insure uniform dispersal of the pollutants over a wide area. The apparatus comprises a large, mobile, collapsible flue having a non-rigid, light-weight, sectioned, chimney-like stack segment which is supported vertically at substantial altitude by a balloon filled with a gas lighter than air. connected to the bottom of the stack is a light-weight, upwardly tapering hood segment supported by the stack and having a large bottom opening corresponding to the ground area to be covered.

For field burning purposes, the stack and hood segments are made of a fireproof material and the bottom hood opening is preferably surrounded by a refractory, rigid-walled enclosure. The rigid enclosure, which may be at least partially supported by the balloon, is elevated above the ground by skid-type supports permitting it to be advanced in a horizontal direction by tow-cables attached to winch-equipped vehicles. An opening is provided at the bottom of the enclosure to permit air to enter and at the top of the enclosure to permit hot, expanding gases to escape into the hood. Refire grids of refractory material are provided within the hood to restrain the natural upward movement of the material being burned until it has been more completely combusted. Preferably the balloon used to support the stack and hood is toroidal shaped and oriented horizontally above the top of the stack in a position such that the rapidly expanding gases emanating therefrom will pass through the orifice formed in the center of the balloon. Cables are employed to suspend the stack from the balloon and tether the balloon to ground-level vehicles. In one embodiment of the field burning apparatus, a multi-section, cylindrical skirt with a cross-section larger than that of the stack is also suspended from the balloon to ensheath the upper section of the stack. This skirt extends above the top of the stack and is gathered near the base of the upper stack section into a plurality of downwardly extending tubes.

When used for field burning, the apparatus of the present invention is placed in the field over the vegetation to be burned and, because of its size, may cover as much as an acre at one time. Once ignited, the vegetation will be retained within the apparatus until it nears complete combustion. By using the refractory rigid-walled enclosure, the bottom of which is elevated and open to permit the introduction of combustion-enriching air, in cooperation with the refire grids employed to restrain the natural upward movement of the matter being combusted, a higher temperature and retention time and therefore a more complete combustion and cleaner emission can be achieved. Furthermore, by utilizing a light-weight, non-rigid stack, the top of which may be elevated to unusually high altitudes merely by adding more stack sections and permitting the balloon supporting the stack to rise accordingly, the particulate matter remaining suspended in the rising gases as they leave the stack can be exhausted at an altitude sufficient to insure its rapid uniform dispersal over a relatively large area. Moreover, the addition of the stack-ensheathing skirt extending vertically above the top of the stack provides a means by which incompletely combusted particulate matter thrown outwardly from the top of the stack may be captured and conducted earthward for ejection at ground level. As the vegetation enclosed by the apparatus is combusted, the apparatus is advanced by the towing vehicles until the entire field has been cleared.

When used to clear fog or smog from an area under conditions of temperature inversion, the apparatus of the present invention, normally without the rigid-walled enclosure or the stack-ensheathing skirt, is positioned in the center of the area and a ssembled with sufficient stack sections to insure that the top of the stack is elevated to an altitude penetrating at least partially through the upper warm mass so that the stack exhausts into relatively cool air. Air heaters or burners are activated near the bottom of the hood and the heated expanding gases rise upwardly through the stack and exhaust while cooler air is drawn into the base of the hood. As the rising gases are expelled from the top of the stack they will, in effect, pierce a hole through the upper warm air mass allowing the gases to continue upward. Thus, an air circulation pattern is established whereby the cooler, highly polluted mass of trapped air is pulled into the bottom of the apparatus, heated therein, and exhausted upwardly through the warmer air mass. This circulation pattern will, after a period of time, completely free the trapped mass of cool air, permitting it to be replaced by clearer and relatively warmer air from the surrounding area.

In those areas with a high incidence of temperature inversion, the apparatus of the present invention may be positioned permanently, thereby permitting its air heaters or burners to be supplied more efficiently with fuel or electricity as the case may be. Moreover, a more efficient collection of fog or smog can be effected by a permanent installation, for example by connecting the opening at the bottom of the apparatus to a municipal sewer system, thereby permitting the apparatus to draw fog or smog from sewer inlets throughout the municipality.

In areas with sufficient sunlight, the apparatus may be constructed of dark-colored, heat-absorbent material so that sunlight striking the apparatus is transferred as heat to the interior of the apparatus where it heats the enclosed air, thereby producing the upward circulation pattern necessary to draw cooler air into the base of the hood and expel warmer, expanding air from the top of the stack at high altitude. In this manner temperature inversions could be destroyed more rapidly than by natural sunlight and without the use of additional energy.

As an example of the air clearing capabilities of the apparatus of the present invention, a stack having a diameter of 40 feet has an area of over 1200 square feet and with an upward flow of only 200 lineal feet per minute could evacuate a volume of over 15 million cubic feet in an hour.

It is, therefore, a principal objective of the present invention to provide a high-capacity apparatus and method for combustibly sterilizing large land areas without a resultant high concentration of airborne pollutants at low altitudes and without attendant limitations on visibility and danger to health.

It is an additional objective of the present invention to provide a high-capacity apparatus and method for the rapid dispersal of fog and smog under temperature inversion conditions.

It is a principal advantage of the present invention that the point at which fog, smog, or incompletely combusted particulate matter is released to the atmosphere from the apparatus is at an exceptionally high altitude.

It is further principal advange of the present invention that its volumetric capacity and land area coverage are of an extremely large magnitude, permitting efficient control of pollutants on a very large scale.

It is an additional advantage of the present invention that the apparatus employed may be readily disassembled and is constructed of light-weight, collapsible, easy-to-transport materials.

It is a further advantage of the present invention that the apparatus, once assembled, may be readily advanced over a relatively horizontal surface despite its large size.

It is a further advantage of the present invention that the concentration of pollutants emitted from the apparatus when used for field burning control may be minimized by approaching complete combustion of particles within the apparatus, and by conducting larger emitted particles back to ground level rather than releasing them to the atmosphere.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1*a* is a detail sectional view of a portion of an alternate embodiment of the field burning apparatus of FIG. 1.

DETAILED DESCRIPTION OF THE INVENTION

Figure 1:
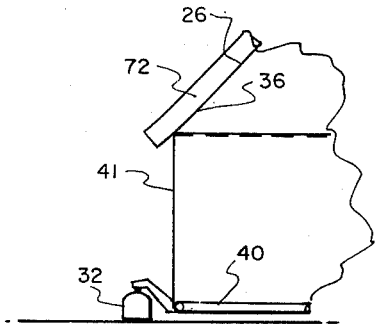
FIG. 1 is a sectional elevation view of the field burning apparatus of the present invention.
Figure 1:
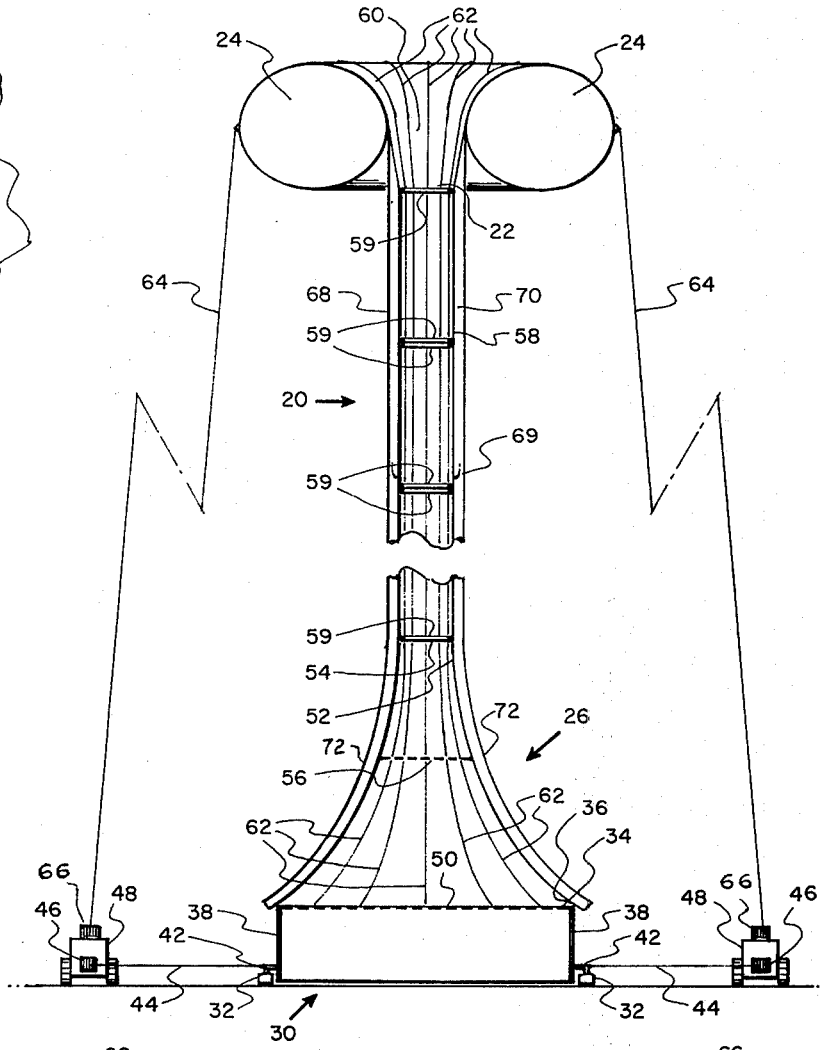

Referring to the figures, the field burning embodiment of the present invention is seen to comprise an upwardly extending chimney-like stack indicated generally at 20 having an upper end 22 suspended from an overhead toroidal-shaped balloon 24, an upwardly tapering hood 26 depending from the lower end 28 of stack 20, and a mobile, walled enclosure 30 supported at its base by a plurality of skid-type support members 32 and connected at its top 34 to the base 36 of hood 26. Enclosure 30 may be formed from a plurality of rigid panels 38 constructed of metal sheet, as indicated in FIG. 1, or of light-weight metal framework covered with a flexible refractory material. Alternatively, as shown in FIG. 1*a*, enclosure 30 may be constructed by suspending a rigid hoop-like frame 40 of circular or rectangular configuration from the base 36 of hood 26 by sheets of flexible refractory material 41 joined together too form the walls of the enclosure. Hoop 40 and its flexible walls 41 may be suspended entirely from hood 26 or supported partially by skid-type support members 32 as shown in the figure. Regardless of the manner in which enclosure 30 is constructed, it is a walled structure only and remains completely open at its base and at its top.

Figure 3:
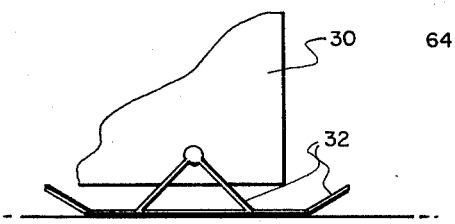
FIG. 3 is a detail view of the apparatus of FIGS. 1 and 2.
Figure 2:
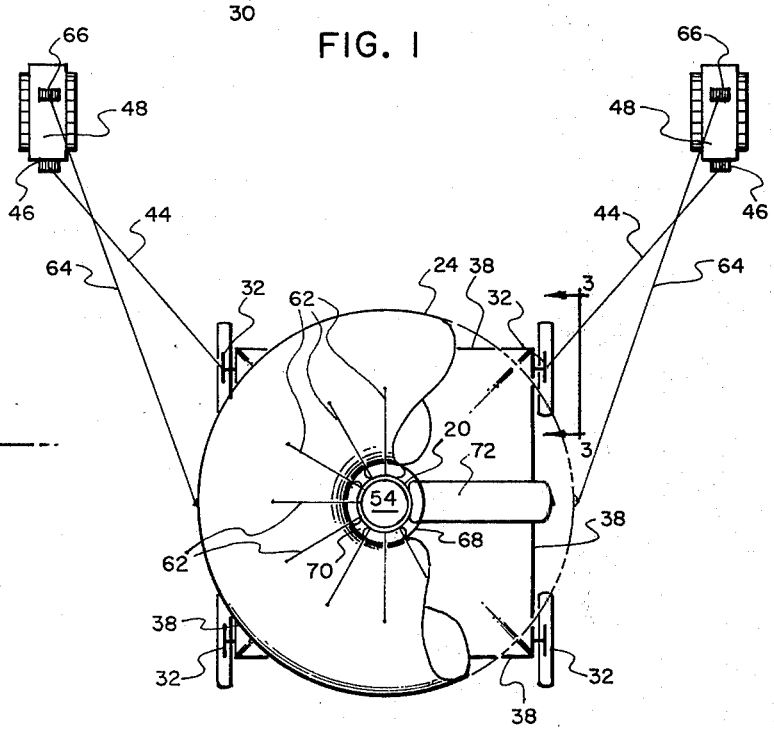
FIG. 2 is a top view of the field burning apparatus of the present invention.

The skid-type support members 32, which may be pivotally attached around the base of enclosure 30 as shown in FIG. 3, serve both to raise the bottom of the enclosure a short distance above ground level and to permit the enclosure to be moved in a horizontal direction over the ground. Although skid-type support members are shown in the figures and would be most appropriate for moving the enclosure over a relatively flat, plowed terrain, wheel- or track-mounted support members could also be employed without departing from the invention. A metal ring 42 or equivalent attachment means is provided at each of the forward support members for the removable attachment of a respective tow cable 44. The other end of the two cables may be attached to a winch 46 mounted on a towing vehicle 48 such as a crawler tractor employed to advance the apparatus. Covering the top 34 of the enclosure 30 is a substantially horizontal refire grid 50 of refractory material, the function of which is discussed below.

Fitted around the top of enclosure 30 and tapering vertically upward therefrom is hood 26 which is likewise open at its bottom 36 and at its top 52. Hood 26 is constructed of a flexible, lightweight, fire-proof material such as a fabric coated with "Teflon" fluorocarbon resin, permitting the hood to be readily taken down and compactly folded for transport or storage. The horizontal cross-section of hood 26 transforms from that of enclosure 30 at the bottom 36 of the hood to that of a circular orifice 54 at the top 52 of the hood. Positioned intermediate refractory grid 50 and orifice 54, and extending across the horizontal cross-section of hood 26, is a second refire grid 56, the function of which is also discussed below. Grids 50 and 56 may be either attached to the interior walls of the hood 26 or supported by a rigid framework attached to the top of enclosure 30.

Attached to hood 26 around orifice 54 and extending upwardly therefrom in a substantially vertical direction is a plurality of tubular stack sections 58 connected end-to-end by any suitable means in a straight line to form the chimney-preferably constructed of a flexible, lightweight, fire-proof material, having rigid hoops such as 59 at the top and bottom of each section to impart a uniformly circular cross-section to the stack from the base 28 of the lowermost section to the top 22 of the uppermost section. Alternatively, it is likely that the pressure of the hot expanding gases would be sufficient to maintain the circular cross-section if hoops such as 59 were not employed.

Floating above the top of the uppermost stack section 58, and supporting the entire stack 20 and hood 26 by means of cables 62 which extend vertically through the apparatus attaching to the various elements, is a toroidal-shaped balloon 24 filled with a lighter-than-air gas such as hydrogen or helium. Balloon 24 is spacially oriented such that the orifice 60 in its center is aligned with the cylindrical sections 58 forming stack 20, such orifice 60 having a diameter larger than that of stack 20. The plurality of support cables 62 attach the balloon peripherally to the top 22 of the uppermost stack section 58 and thereafter to the tops of each successively lower stack section, hood 26 and enclosure 30 respectively. The size of balloon 24 is such that the force exerted upwardly by the gas contained therein is sufficient to maintain stack 20 and hood 26 in a substantially taut, vertical position. If a hoop such as 40 is employed to form enclosure 30, or if enclosure 30 is otherwise constructed from sufficiently light-weight materials, and balloon 24 is made sufficiently large, the entire apparatus, including the enclosure 30, may be supported substantially by the balloon. Of course when the apparatus is operating, the expanding gases will exert an upward pressure against the hood also helping to support the hood and enclosure 30.

A respective balloon tethering cable 64 extends from an attachment point at each side of balloon 24 to a second winch 66 mounted on each of the ground-based vehicles 46 employed to advance enclosure 30, such vehicles having sufficient cumulative weight in combination with the apparatus to prevent uncontrolled rising of the balloon. These cables control the altitude of the balloon during operation and during erection and disassembly of the apparatus, also ensuring that stack 20 and hood 26 remain substantially vertical despite lateral movement of the apparatus and changing wind conditions.

Depending from the periphery of the orifice 60 formed in the center of balloon 24 and concentric with stack 20 is a tubular, stack-ensheathing skirt 68 also constructed from a flexible, light-weight, fire-proof material. The top of the skirt 68 is higher than the top of the stack 20 and its cross-section is larger than that of stack 20 to create an annular cavity 70 along the portion of the stack ensheathed by the skirt. Skirt 68 is gathered at its base 69 and transformed into a plurality of tubular conduits 72 extending downwardly along the sides of burner hood 26 to near ground level. Conduits 72 may also be constructed from individual sections to adjustably match the height of the skirt base.

In operation as a field burning aid to combustibly sterilize agricultural land after the main crop has been harvested, the apparatus of the present invention is transported to the field in its collapsed or knocked down configuration, with the various flexible fabric elements and balloon 24 folded compactly and the rigid portions disassembled. Once at the field, enclosure 30 is assembled over an area of vegetation to be burned, the base 36 of hood 26 is attached around the top 34 of enclosure 30, and stack sections 58 are joined end-to-end to form stack 20 of adjustable predetermined length depending upon the number of sections 58 employed. The base 28 of the stack is then joined to the top 52 of hood 26 around orifice 54 and the skirt 68 is positioned over the top section of the stack. During assembly, the supporting cables 62 are attached to the various elements and attached at their tops to balloon 24. The top of skirt 68 is also attached directly to the balloon around orifice 60. Lastly, the base of skirt 68 is attached to the conduits 72 extending downwardly along the sides of hood 26, enclosure 30 is connected to two-vehicles 48 by cables 44, and the balloon 24 is tethered to vehicles 48 by cables 64.

The balloon may thereafter be inflated with a sufficient quantity of a lighter-than-air gas to raise the balloon a distance sufficient to pull stack 20 and hood 26 vertically taut.

When the vegetation contained within enclosure 30 is ignited, the rapidly expanding gases created by the combustion of the vegetation will be collected by hood 26 and directed vertically upward through stack 20. Any incompletely combusted particulate matter suspended within the gases will be restrained from upward movement by refractory grids 50 and 56 until it has been reduced by further combustion to a size sufficiently small to allow passage through the grids. The interstitial apertures of grid 56 may be made smaller than those of grid 50 so that matter initially restrained by grid 50 will be further restrained by grid 56 until combusted more completely.

As with any fluid moving through a conduit, the hot expanding gases traveling upwardly through stack 20 will travel faster at the center of the stack than at the periphery, thereby causing any particulate matter suspended in the gases to accumulate around the periphery. As these gases reach the top of stack 20, they expand outwardly therefrom in all directions causing the slower moving gases around the periphery of the stack to spill over and impinge the interior surface of skirt 68 extending above the top of the stack. Particulate matter remaining in these slower moving gases is also thrown outwardly from the top of stack 20 whereupon the upward travel of the matter is slowed or stopped, permitting it to fall downwardly through the annular cavity 70 between stack 20 and skirt 68 and out the base of conduits 72. Thus, that matter not completely combusted in the first instance will be retained within enclosure 30 and hood 26 by refractory grids 50 and 56, respectively, until it has been more completely combusted, and a substantial portion of the matter passing through the refractory grids, because of its tendency to accumulate around the periphery of stack 20, will be thrown outward from the top thereof, impinge the interior of skirt 68 and fall earthward through the cavity formed between the stack and the skirt. The result is a relatively clean emission from the top of the stack.

Because of the light-weight, flexible material employed in the construction of the stack, hood and skirt, and the use of a lighter-than-air gas-filled balloon to vertically support these components, the point at which the expanding gases are released to the atmosphere can be located at a predetermined altitude sufficient to ensure the rapid uniform dispersal the gases over a relatively wide area, thereby minimizing or eliminating their visibility-limiting and health-endangering effect, simply by utilizing the necessary number of stack sections.

The apparatus of the present invention may also be utilized to remove fog and smog caused by a local temperature inversion. In these instances, balloon 24, stack 20 and hood 26 are assembled without enclosure 30 or skirt 68 and positioned in the center of the area of relatively cool air that is being held in place by the larger body of relatively warm air. As the apparatus would not normally need to be mobile for this application, the balloon and the base of the hood could accordingly be tethered to fixed objects to hold the balloon at proper altitude and keep the hood properly expanded at its base. Sufficient stack sections 58 are used to ensure that the top of stack 20 penetrates at least partially, and preferably entirely, through the warm overhead air mass. Air heaters or burners may be located around the base of the apparatus and activated so as to exhaust heated air upwardly into the base of hood 26. As the hot expanding gases produced by the heaters or burners advance vertically upward from hood 26 through stack 20, an air circulation pattern is created whereby cooler air is drawn into the opening at the bottom of hood 26 and expelled from the top 22 of stack 20. With the top of the stack located at or above the level of the warmer air mass, these hot expanding gases will, in effect, punch a hole through the warmer air mass and carry any pollutants entering with the air through the opening at the base of hood 26 to a height above the warm air mass sufficient to ensure their rapid uniform dispersal over a wide area. This process is continued until the necessary volume of relatively cool, polluted air has been drawn into the base of the apparatus, heated therein and expelled above the relatively warm air mass to destroy the temperature inversion trapping the cooler air.

In an area of frequent smog- or fog-producing temperature inversions, more than one apparatus of the present invention may be permanently assembled at strategic locations and utilized for both smog and fog removal. If desired, the base of hood 26 could be connected to a municipal sewer system allowing the cooler polluted air to be drawn into the apparatus via the sewer system from a relatively large area.

As a preventive measure, to control the initial formation of smog or fog, the apparatus of the present invention may be stored at its permanent location with the balloon 24 retained at or near the ground and hood 26 and stack 20 folded into a collapsed or lowered condition near or on the ground but ready to be elevated immediately when desired, thereby eliminating the danger to flying objects and unsightliness which might be created if the apparatus were fully extended at all times. At the first instance when the formation of smog or fog in the general area is detected by visual or other means, balloon 24 may be permitted to rise thereby elevating stack 20 and hood 26, and the apparatus may be operated as described above to prevent or limit the formation of fog or smog at the outset.

In those areas with sufficient sunlight, the exterior surface of the smog-removing apparatus may be constructed of a dark-colored, heat-absorbent material permitting the air within the apparatus to be heated by solar energy. The heat thus produced will cause the air within the apparatus to expand and rise up stack 20, thereby creating the air circulation patterns necessary to draw the cooler polluted air into the base of the apparatus and expel it at an altitude sufficient to destroy the temperature inversion.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for conducting airborne pollutants from ground level to a high altitude comprising:

a. open-bottomed, upwardly tapering hood means of light-weight flexible material for collecting an expanding gas rising from the ground, said hood means having a bottom peripheral edge supported a predetermined distance above the ground so as to define a peripheral space between said bottom edge and the ground through which air may enter said hood means, said hood means also having means at its top defining an orifice through which said gas may be conducted vertically upward;

b. tubular stack means of light-weight flexible material matingly coupled with said orifice and rising vertically above said hood means for conducting said expanding gas from said hood means to the atmosphere; and c. lighter-than-air balloon means having said stack means and said hood means suspended therefrom such that both said stack means and said hood means are solely supported by said balloon means above the ground.

2. An apparatus for conducting airborne pollutants from ground level to a high altitude comprising:

a. open-bottomed, upwardly-tapering hood means for collecting an expanding gas rising from the ground, said hood means having means at its top defining an orifice through which said gas may be conducted vertically upward;

b. tubular stack means matingly coupled with said orifice and rising vertically above said hood means for conducting said expansing gas from said hood means to the atmosphere;

c. lighter-than-air balloon means having said stack means suspended therefrom for supporting said stack means above the ground; and d. open-topped skirt means for ensheathing a portion of said stack means adjacent its top and forming an enclosed space around said stack means, said skirt means being attached to and suspended from said balloon means.

3. The apparatus of claim 2 further comprising flexible conduit means attached to the bottom of said skirt means for conducting particulate matter located within said enclosed space to ground level.

4. The apparatus of claim 2 wherein the top of said skirt means extends above the top of said stack means.

* * * * *

UNITED STATES PATENT AND TRADEMARK OFFICE

CERTIFICATE OF CORRECTION

PATENT NO. : 3,974,756

DATED : August 17, 1976

INVENTOR(S) : Otto V. Long

It is certified that error appears in the above-identified patent and that said Letters Patent are hereby corrected as shown below:

| | | |
|---|---|---|
| Col. 1, | Line 45 | Change "tempeprature" to --temperature--. |
| Col. 2, | Line 13 | Change "connected" to --Connected--. |
| Col. 3, | Line 11 | Change "a ssembled" to --assembled--. |
| Col. 4, | Line 5 | After "is" insert the word --a--, |
| | Line 59 | Change " too" to --to--. |
| Col. 6, | Line 50 | Change "two-vehicles" to --tow-vehicles--. |
| Col. 9, | Line 12 | Change "expansing" to --expanding--. |

Signed and Sealed this

Twenty-eighth Day of December 1976

[SEAL]

*Attest:*

RUTH C. MASON
*Attesting Officer*

C. MARSHALL DANN
*Commissioner of Patents and Trademarks*